US006791039B1

(12) United States Patent
Tuniewicz et al.

(10) Patent No.: US 6,791,039 B1
(45) Date of Patent: Sep. 14, 2004

(54) MULTI-TERMINAL ELECTRICAL SAFETY SWITCH FOR SIMULTANEOUSLY CLOSING AND OPENING ELECTRICAL CIRCUITS CONNECTED THERETO

(76) Inventors: Robert M. Tuniewicz, 14 Remsen Ct., Mt. Sinai, NY (US) 11766; Gilbert D. Talamo, P.O. Box 434, Great River, NY (US) 11739

( * ) Notice: Subject to any disclaimer, the term of this patent is extended or adjusted under 35 U.S.C. 154(b) by 0 days.

(21) Appl. No.: 10/675,898

(22) Filed: Sep. 30, 2003

Related U.S. Application Data

(60) Provisional application No. 60/414,467, filed on Sep. 30, 2002.

(51) Int. Cl.[7] ..... H01R 31/08

(52) U.S. Cl. ..... 200/17 R; 200/43.05

(58) Field of Search ..... 200/1 R, 17 R, 200/18, 43.01, 43.02, 43.04, 43.05, 43.07, 43.09, 334; 439/189, 308, 509

(56) References Cited

U.S. PATENT DOCUMENTS

RE34,113 E * 10/1992 Miller et al. ..... 361/643
5,406,449 A * 4/1995 Hicks et al. ..... 361/616
5,842,560 A * 12/1998 Kuki et al. ..... 200/43.05
6,118,091 A * 9/2000 Matsumoto et al. ..... 200/293
6,337,447 B1 * 1/2002 Wise et al. ..... 200/17 R

* cited by examiner

*Primary Examiner*—Michael A. Friedhofer
(74) *Attorney, Agent, or Firm*—Richard L. Miller, P.A.

(57) ABSTRACT

A multi-terminal electrical safety switch that simultaneously closes or simultaneously opens electrical circuits connected thereto. The switch includes a terminal block and a current path completer/breaker. The terminal block has the electrical circuits connected thereto and the current path completer/breaker is replaceably engaged with the terminal block. The current path completer/breaker simultaneously completes current paths through the terminal block when engaged with the terminal block and thereby simultaneously closes the electrical circuits connected to the terminal block. The current path completer/breaker simultaneously breaks the current paths through the terminal block when removed from the terminal block and thereby simultaneously opens the electrical circuits connected to the terminal block so as to allow the electrical circuits connected to the terminal block to be safely worked on without any inadvertent closing of any of the electrical circuits by virtue of the current path completer/breaker being physically removed from the terminal block.

32 Claims, 2 Drawing Sheets

MULTI-TERMINAL ELECTRICAL SAFETY SWITCH FOR SIMULTANEOUSLY CLOSING AND OPENING ELECTRICAL CIRCUITS CONNECTED THERETO

CROSS REFERENCE TO RELATED APPLICATIONS

The instant application is a nonprovisional application of U.S. provisional application No. 60/414,467 filed on Sep. 30, 2002, and entitled INTEGRATED TERMINAL BLOCK AND DISCONNECT SWITCH WITH REMOVABLE PULLOUT SWITCH HANDLE, and it is respectfully requested that this application be accorded the benefit under 35 USC 119(e) of said U.S. provisional application.

BACKGROUND OF THE INVENTION

1. Field of the Invention

The present invention relates to an electrical switch for simultaneously closing or simultaneously opening electrical circuits connected thereto. More particularly, the present invention relates to a multi-terminal electrical safety switch for simultaneously closing or simultaneously opening electrical circuits connected thereto.

2. Description of the Prior Art

Numerous innovations for electrical switches have been provided in the prior art. Even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a multi-terminal electrical safety switch for simultaneously closing or simultaneously opening electrical circuits connected thereto that avoids the disadvantages of the prior art.

ANOTHER OBJECT of the present invention is to provide a multi-terminal electrical safety switch for simultaneously closing or simultaneously opening electrical circuits connected thereto that is simple to use.

BRIEFLY STATED, STILL ANOTHER OBJECT of the present invention is to provide a multi-terminal electrical safety switch that simultaneously closes or simultaneously opens electrical circuits connected thereto. The switch includes a terminal block and a current path completer/breaker. The terminal block has the electrical circuits connected thereto and the current path completer/breaker is replaceably engaged with the terminal block. The current path completer/breaker simultaneously completes current paths through the terminal block when engaged with the terminal block and thereby simultaneously closes the electrical circuits connected to the terminal block. The current path completer/breaker simultaneously breaks the current paths through the terminal block when removed from the terminal block and thereby simultaneously opens the electrical circuits connected to the terminal block so as to allow the electrical circuits connected to the terminal block to be safely worked on without any inadvertent closing of any of the electrical circuits by virtue of the current path completer/breaker being physically removed from the terminal block.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
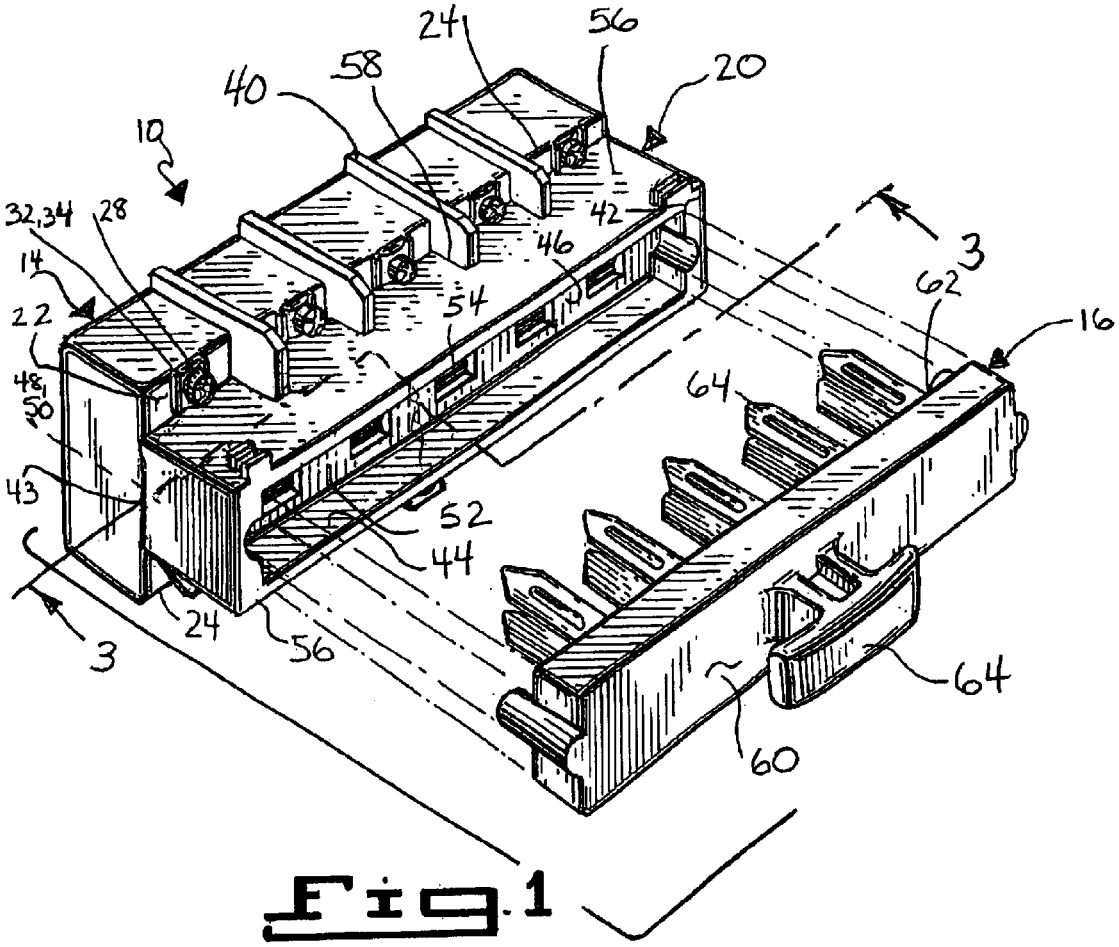
FIG. 1 is an exploded diagrammatic perspective view of the present invention.

10 multi-terminal electrical safety switch of present invention for simultaneously closing or simultaneously opening electrical circuits 12 connected thereto
12 electrical circuits
14 terminal block
16 current path completer/breaker
18 current paths
20 insulative block
22 top surface of terminal block 14
24 pair of side edges of terminal block 14
26 longitudinal center line of terminal block 14
28 at least one pair of terminals of terminal block 14
30 at least one socket of terminal block 14
32 pair of strips of each socket of at least one socket 30 of terminal block 14
34 flat portion of each strip of pair of strips 32 of at least one socket 30 of terminal block 14
36 substantially U-shaped portion of each strip of pair of strips 32 of at least one socket 30 of terminal block 14
38 primary partition of terminal block 14
40 at least one secondary partition of terminal block 14
42 top surface of insulative block 20
43 bottom surface of insulative block 20
44 first recess in insulative block 20
46 floor defining first recess 44 in insulative block 20
48 second recess in insulative block 20
50 ceiling defining second recess 48 in insulative block 20
52 partition in insulative block 20
54 at least one pair of through slots in partition 52 in insulative block 20
56 pair of side walls further defining second recess 48 in insulative block 20
58 pair of through slots in pair of side walls 56 of insulative block 20
60 top surface of current path completer/breaker 16
62 bottom surface of current path completer/breaker 16
64 handle of current path completer/breaker 16
66 at least one fork of current path completer/breaker 16

DETAILED DESCRIPTION OF THE PREFERRED EMBODIMENT

Figure 2:
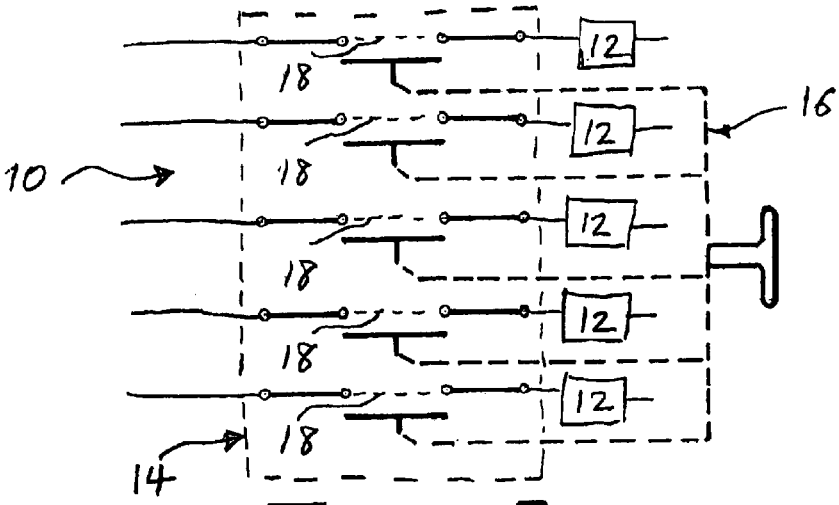
FIG. 2 is a schematic of the present invention.

Referring now to the figures, in which like numerals indicate like parts, and particularly to FIGS. 1 and 2, the multi-terminal electrical safety switch of the present invention is shown generally at 10 for simultaneously closing or simultaneously opening electrical circuits 12 connected thereto.

The multi-terminal electrical safety switch 10 comprises a terminal block 14 and a current path completer/breaker 16.

The terminal block 14 has the electrical circuits 12 connected thereto and the current path completer/breaker 16 is replaceably engaged with the terminal block 14.

The current path completer/breaker 16 simultaneously completes current paths 18 through the terminal block 14 when engaged with the terminal block 14 and thereby simultaneously closes the electrical circuits 12 connected to the terminal block 14.

The current path completer/breaker 16 simultaneously breaks the current paths 18 through the terminal block 14 when removed from the terminal block 14 and thereby simultaneously opens the electrical circuits 12 connected to the terminal block 14 so as to allow the electrical circuits 12 connected to the terminal block 14 to be safely worked on without any inadvertent closing of any of the electrical circuits 12 by virtue of the current path completer/breaker 16 being physically removed from the terminal block 14.

The multi-terminal electrical safety switch 10 further comprises an insulative block 20. The insulative block 20 replaceably attaches to the terminal block 14 and is replaceably engaged by the current path completer/breaker 16.

Figure 3:
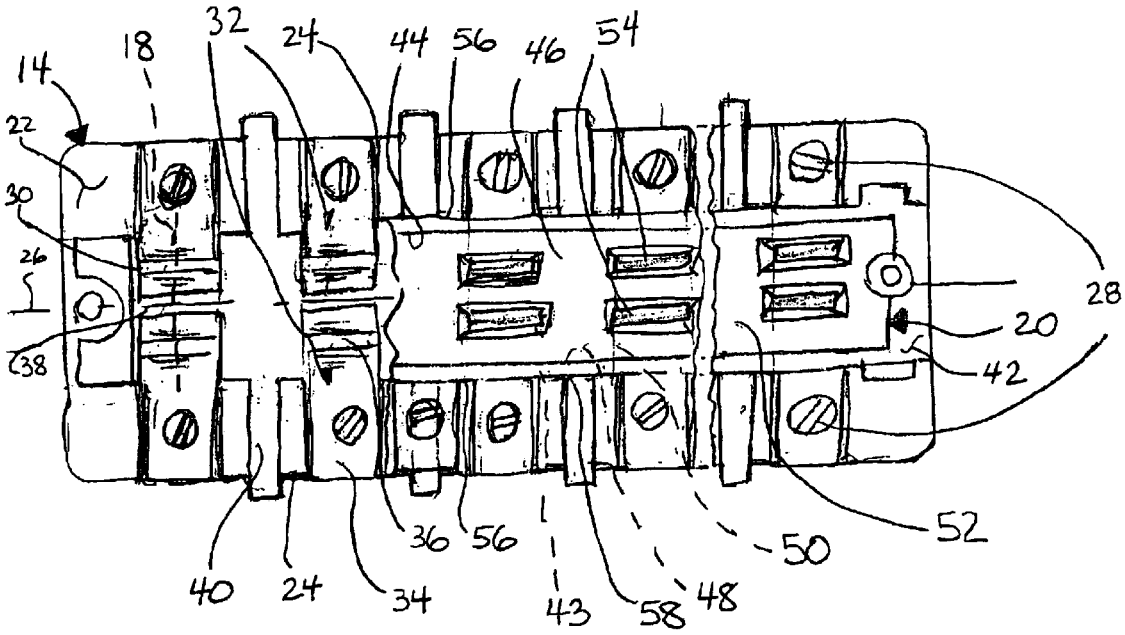
FIG. 3 is an enlarged diagrammatic top plan view taken along line 3—3 in FIG. 1.

The specific configuration of the terminal block 14 and the insulative block 20 can best be seen in FIGS. 1 and 3, and as such, will be discussed with reference thereto.

The terminal block 14 is generally rectangular-parallelepiped-shaped, and has a top surface 22, a pair of side edges 24, and a longitudinal center line 26.

The terminal block 14 further has at least one pair of terminals 28. Each pair of terminals of the at least one pair of terminals 28 of the terminal block 14 are transversely aligned with each other and are associated with a current path of the current paths 18.

The at least pair of terminals 28 of the terminal block 14 is disposed on the top surface 22 of the terminal block 14, at the pair of side edges 24 of the terminal block 14, respectively.

The terminal block 14 further has at least one socket 30. The at least one socket 30 of the terminal block 14 electrically communicates an associated pair of terminals of the at least one pair of transversely aligned terminals 28 of the terminal block 14 with each other when the current path completer/breaker 16 is engaged with the terminal block 14 thereby completing a current path of the current paths 18 associated therewith. The at least one socket 30 of the terminal block 14 is disposed on the top surface 22 of the terminal block 14.

Each socket of the at least one socket 30 of the terminal block 14 comprises a pair of strips 32. The pair of strips of each socket of the at least one socket 30 of the terminal block 14 are transversely aligned with each other. Each strip of the pair of strips 32 of the at least one socket 30 of the terminal block 14 is electrically conductive, bendable, and resilient.

Each strip of the pair of strips 32 of the at least one socket 30 of the terminal block 14 has a flat portion 34 and a substantially U-shaped portion 36. The substantially U-shaped portion 36 of each strip of the pair of strips 32 of the at least one socket 30 of the terminal block 14 extends from the flat portion 34 of an associated strip of the pair of strips 32 of the at least one socket 30 of the terminal block 14.

The flat portion 34 of each strip of the pair of strips 32 of the at least one socket 30 of the terminal block 14 is electrically communicatingly attached to an associated terminal of the at least one pair of terminals 28 of the terminal block 14, and the substantially U-shaped portion 36 of each strip of the pair of strips 32 of the at least one socket 30 of the terminal block 14 depends into the terminal block 14.

The terminal block 14 further has a primary partition 38. The primary partition 38 of the terminal block 14 separates the pair of strips 32 of each socket of the at least one socket 30 of the terminal block 14 from each other. The primary partition 38 of the terminal block 14 extends along the longitudinal centerline 26 of the terminal block 14.

The terminal block 14 further has at least one secondary partition 40 when the at least one pair of terminals 28 of the terminal block 14 is more than one pair. Each secondary partition of the at least one secondary partition 40 of the terminal block 14 separates adjacent terminals of the at least one pair of terminals 28 of the terminal block 14 from each other.

Each secondary partition of the at least one secondary partition 40 of the terminal block 14 intersects the primary partition 38 of the terminal block 14, and extends from one side edge of the pair of side edges 24 of the terminal block 14 to the other side edge of the pair of side edges 24 of the terminal block 14.

The insulative block 20 is substantially rectangular-parallelepiped-shaped, and has a top surface 42 and a bottom surface 43.

The insulative block 20 insulatively protects the at least one socket 30 of the terminal block 14 when attached to the terminal block 14 and insulatively protects the current path completer/breaker 16 when engaged with the terminal block 14.

The insulative block 20 further has a first recess 44. The first recess 44 in the insulative block 20 is defined by a floor 46, replaceable receives the current path completer/breaker 16, and depends in the top surface 42 of the insulative block 20.

The insulative block 20 further has a second recess 48. The second recess 48 in the insulative block 20 is defined by a ceiling 50, replaceably receives the primary partition 38 of the terminal block 14, and extends in the bottom surface 43 of the insulative block 20.

The floor 46 of the first recess 44 in the insulative block 20 and the ceiling 50 of the second recess 48 in the insulative block 20 form a partition 52 in the insulative block 20. The partition 52 in the insulative block 20 has at least one pair of through slots 54. Each pair of through slots of the at least one pair of through slots 54 in the partition 52 in the insulative block 20 are transversely aligned with each other and aligned with an associated socket of the at least one socket 30 of the terminal block 14.

The second recess 48 in the insulative block 20 is further defined by a pair of side walls 56. The pair of aide walls 56 of the second recess 48 in the insulative block 20 has at least one pair of through slots 58 when the at least one secondary partition 40 of the terminal block 14 is present. Each pair of through slots 68 in the pair of side walls 56 of the second recess 48 in the insulative block 20 are transversely aligned with each other. The at least one pair of through slots 58 in the pair of side walls 56 of the second recess 48 in the insulative block 20 receive an associated secondary partition of the at least one secondary partition 40 of the terminal block 14.

The specific configuration of the current path completer/breaker 16 can best be seen in FIG. 1, and as such, will be discussed with reference thereto.

The current path completer/breaker 16 is generally rectangular-parallelepiped-shaped, and has a top surface 60 and a bottom surface 62.

The current path completer/breaker 16 further has a handle 64. The handle 64 of the current path completer/breaker 16 extends upwardly from the top surface 60 of the current path completer/breaker 16, and is generally T-shaped to facilitate gripping of the current path completer/breaker 16 when the current path completer/breaker 16 is being disengaged from the insulative block 20 and the terminal block 14.

The current path completer/breaker 16 further has at least one fork 66. Each fork of the at least one fork 66 of the current path completer/breaker 16 is two pronged, is electrically conductive, depends from the bottom surface 62 of the current path completer/breaker 16, and is substantially inverted U-shaped.

Each fork of the at least one fork 66 of the current path completer/breaker 16 passes through an associated pair of through slots of the at least one pair of through slots 54 in the partition 46 in the insulative block 20 and engagingly into an associated socket of the at least one socket 30 of the terminal block 14 when the current path completer/breaker 16 is engaged in the insulative block 20, and in so doing, simultaneously completes the current paths 18 through the terminal block 14 and thereby simultaneously closes the electrical circuits 12 connected to the terminal block 14. Conversely when each fork of the at least one fork 66 of the current path completer/breaker 16 is disengaged from the associated socket of the at least one socket 30 of the terminal block 14 and removed from the associated pair of through slots of the at least one pair of through slots 54 in the partition 46 in the insulative block 20 by the current path completer/breaker 16 being disengaged from the insulative block 20 the current paths 18 through the terminal block 14 are simultaneously broken and thereby the electrical circuits 12 connected to the terminal block 14 are simultaneously opened.

It will be understood that each of the elements described above, or two or more together, may also find a useful application in other types of constructions differing from the types described above.

While the invention has been illustrated and described as embodied in a multi-terminal electrical safety switch for simultaneously closing or simultaneously opening electrical circuits connected thereto, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A multi-terminal electrical safety switch for simultaneously closing or simultaneously opening electrical circuits connected thereto, comprising:

a) a terminal block; and b) a current path completer/breaker;

wherein said terminal block is for having the electrical circuit connected thereto;

wherein said current path completer/breaker is replaceably engaged with said terminal block;

wherein said current path completer/breaker simultaneously completes current path through said terminal block when engaged with said terminal block and thereby simultaneously closes the electrical circuits connected to said terminal block; and wherein said current path completer/breaker simultaneously breaks the current paths through said terminal block when removed from said terminal block and thereby simultaneously opens the electrical circuits connected to said terminal block so as to allow the electrical circuits connected to said terminal block to be safely worked on without any inadvertent closing of any of the electrical circuits by virtue of said current path completer/breaker being physically removed from said terminal block; further comprising an insulative block;

wherein said insulative block relaceably attaches to said terminal block; and wherein said insulative block is replaceably engaged by said current path completer/breaker, wherein said terminal block has at least one pair of terminals;

wherein each pair of terminals of said at least one pair of terminals of said terminal block are transversely aligned with each other; and wherein each pair of terminals of said at least one pair of terminals of said terminal block is associated with a current path of the at least one current path.

2. The switch as defined in claim 1, wherein said terminal block is generally rectangular-parallelepiped-shaped.

3. The switch as defined in claim 1, wherein said terminal block has a top surface;

wherein said terminal block has a pair of side edges;

wherein said at least one pair of terminals of said terminal block is disposed on said top surface of said terminal block; and wherein each terminal of said at least one pair of terminals is disposed at an associated one of the side edges of said pair of side edges of said terminal block.

4. The switch as defined in claim 1, wherein said terminal block has at least one socket; and wherein said at least one socket electrically communicates a pair of terminals of said at least one pair of terminals of said terminal block with each other when said current path completer/breaker is replaceably engaged with said terminal block thereby completing a current path of the at least one current path associated therewith.

5. The switch as defined in claim 4, wherein said terminal block has a top surface; and wherein said at least one socket is disposed on said top surface of said terminal block.

6. The switch as defined in claim 4, wherein each socket of said at least one socket in said terminal block comprises a pair of strips; and wherein said pair of strips of each socket of said at least one socket in said terminal block are transversely aligned with each other.

7. The switch as defined in claim 6, wherein each strip of said pair of strips of said at least one socket of said terminal block is electrically conductive;

wherein each strip of said pair of strips of said at least one socket of said terminal block is bendable; and wherein each strip of said pair of strips of said at least one socket of said terminal block is resilient.

8. The switch as defined in claim 6, wherein each strip of said pair of strips of said at least one socket of said terminal block has a flat portion;

wherein each strip of said pair of strips of said at least one socket of said terminal block, has a substantially U-shaped portion; and wherein said substantially U-shaped portion of each strip of said pair of strips of said at least one socket of said terminal block extends from said flat portion of an associated strip of said pair of strips of said at least one socket of said terminal block.

9. The switch as defined in claim 8, wherein said flat portion of each strip of said pair of strips of said at least one socket of said terminal block is electrically communicatingly attached to an associated terminal of said at least one pair of terminals of said terminal block; and wherein said substantially U-shaped portion of each strip of said pair of strips of said at least one socket of said terminal block depends into said terminal block.

10. The switch as defined in claim 6, wherein said terminal block has a primary partition; and wherein said primary partition of said terminal block separates said pair of strips of each socket of said at least one socket of said terminal block from each other.

11. The switch as defined in claim 10, wherein said terminal block has a longitudinal center line; and wherein said primary partition of said terminal block extends along said longitudinal centerline of said terminal block.

12. The switch as defined in claim 10, wherein said terminal block has at least one secondary partition; and wherein each secondary partition of said at least one secondary partition of said terminal block separates adjacent terminals of said at least one pair of terminals of said terminal block from each other.

13. The switch as defined in claim 12, wherein each secondary partition of said at least one secondary partition of said terminal block intersects said primary partition of said terminal block; and wherein each secondary partition of said at least one secondary partition of said terminal block terminal block extends from one side edge of said pair of side edges of said terminal block to the other side edge of said pair of side edges of said terminal block.

14. The switch as defined in claim 12, wherein insulative block has a first recess;

wherein said first recess in said insulative block is defined by a floor; and wherein said first recess in said insulative block replaceably receives said current path completer/breaker.

15. The switch as defined in claim 14, wherein said insulative block has a top surface; and wherein said first recess in said insulative block depends in said top surface of said insulative block.

16. The switch as defined in claim 14, wherein said insulative block has a second recess;

wherein said second recess in said insulative block is defined by a ceiling; and wherein said second recess in said insulative block replaceably receives said primary partition of said terminal block.

17. The switch as defined in claim 16, wherein said insulative block has a bottom surface; and wherein said second recess in said insulative block extends in said bottom surface of said insulative block.

18. The switch as defined in claim 16, wherein said floor of said first recess in said insulative block and said ceiling of said second recess in said insulative block form a partition in said insulative block.

19. The switch as defined in claim 18, wherein said partition in insulative block has at least one pair of through slots;

wherein each pair of through slots of said at least one pair of through slots in said partition in insulative block are transversely aligned with each other; and wherein each pair of through slot of said at least one pair of through slots in said partition in said insulative block aligns with an associated socket of said at least one socket of said terminal block.

20. The switch as defined in claim 19, wherein said current path completer/breaker has at least one fork; and wherein each fork of said at least one fork of said current path completer/breaker is two pronged.

21. The switch as defined in claim 20, wherein each fork of said at least one fork of said current path completer/breaker is electrically conductive.

22. The switch as defined in claim 20, wherein said at least one fork of said current path completer/breaker depends from said current path completer/breaker.

23. The switch as defined in claim 20, wherein said current path completer/breaker has a bottom surface; and wherein said at least one fork of said current path completer/breaker depends from said bottom surface of said current path completer/breaker.

24. The switch as defined in claim 20, wherein each fork of said at least one fork of said current path completer/breaker is substantially inverted U-shaped.

25. The switch as defined in claim 20, wherein each fork of said at least one fork of said current path completer/breaker passes through an associated pair of through slots of said at least one pair of through slots in said partition in said insulative block and engagingly into an associated socket of said at least one socket of said terminal block when said current path completer/breaker is engaged in said insulative block, and in so doing, simultaneously completes the current paths through said terminal block and thereby simultaneously closes the electrical circuits connected to said terminal block and when each fork of said at least one fork of said current path completer/breaker is disengaged from said associated socket of said at least one socket of said terminal block and removed from said associated pair of through slots of said at least one pair of through slots in said partition in said insulative block by said current path completer/breaker being disengaged from said insulative block the current paths through said terminal block are simultaneously broken and thereby the electrical circuits connected to said terminal block are simultaneously opened.

26. The switch as defined in claim 16, wherein said second recess in said insulative block is defined by a pair of side walls.

27. The switch as defined in claim 26, wherein said pair of side walls of said insulative block has at least one pair of through slots when said at least one secondary partition of said terminal block is present;

wherein each pair of through slots of said at least one pair of through slots in said pair of side walls of said insulative block are transversely aligned with each other; and wherein said at least one pair of through slots in said pair of side walls of said insulative block receive an associated secondary partition of said at least one secondary partition of said terminal block.

28. The switch as defined in claim 4, wherein said insulative block insulatively protects said at least one socket of said terminal block when attached to said terminal block; and wherein said insulative block insulatively protects said current path completer/breaker when said current path completer/breaker is engaged therewith.

29. The switch as defined in claim 1, wherein said current path completer/breaker is generally rectangular-parallelepiped-shaped.

30. The switch as defined in claim 1, wherein said current path completer/breaker has a handle.

31. The switch as defined in claim 30, wherein said current path completer/breaker has a top surface; and wherein said handle of said current path completer/breaker extends upwardly from said top surface of said current path completer/breaker.

32. The switch as defined in claim 30, wherein said handle of said current path completer/breaker is generally T-shaped; and wherein said T-shape of said current path completer/breaker facilitates gripping of said current path completer/breaker when said current path completer/breaker is being disengaged from said insulative block and said terminal block.

* * * * *